US008428283B2

(12) United States Patent
Mimura et al.

(10) Patent No.: US 8,428,283 B2
(45) Date of Patent: Apr. 23, 2013

(54) MANUFACTURING METHOD OF PAPER MAKING PART FOR LOUDSPEAKER, PAPER MAKING PART FOR LOUDSPEAKER, DIAPHRAGM FOR LOUDSPEAKER, SUB CONE FOR LOUDSPEAKER, DUST CAP FOR LOUDSPEAKER AND LOUDSPEAKER

(75) Inventors: Kazuyoshi Mimura, Mie (JP); Kenichi Ajiki, Mie (JP); Shinya Mizone, Mie (JP); Masahide Sumiyama, Mie (JP); Toru Fujii, Shiga (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/397,815

(22) Filed: Feb. 16, 2012

(65) Prior Publication Data

US 2012/0145345 A1 Jun. 14, 2012

Related U.S. Application Data

(62) Division of application No. 11/813,555, filed as application No. PCT/JP2007/053352 on Feb. 23, 2007, now Pat. No. 8,144,912.

(30) Foreign Application Priority Data

Mar. 1, 2006 (JP) ..... 2006-054541
Mar. 29, 2006 (JP) ..... 2006-091189

(51) Int. Cl.
*H04R 1/20* (2006.01)

(52) U.S. Cl.
USPC ..... 381/337; 381/396; 162/1; 162/21; 162/28; 162/100; 162/157.2

(58) Field of Classification Search ..... None
See application file for complete search history.

(56) References Cited

U.S. PATENT DOCUMENTS

| | | | |
|---|---|---|---|
| 4,374,702 | A | 2/1983 | Turbak et al. |
| 5,274,199 | A | 12/1993 | Uryu et al. |
| 6,059,926 | A | 5/2000 | Hiroshima |

FOREIGN PATENT DOCUMENTS

| | | | |
|---|---|---|---|
| CN | 1655647 | A | 8/2005 |
| JP | 61-019893 | | 1/1986 |
| JP | 61-019894 | | 1/1986 |
| JP | 63-126985 | A | 5/1988 |
| JP | 63-196790 | | 8/1988 |
| JP | 01-269394 | | 10/1989 |
| JP | 03-120999 | | 5/1991 |

(Continued)

OTHER PUBLICATIONS

Japanese Office Action for Application No. 2006-054541, Feb. 8, 2011, Panasonic Corporation.

(Continued)

*Primary Examiner* — Julio J Maldonado
*Assistant Examiner* — Yasser Abdelaziez
(74) *Attorney, Agent, or Firm* — RatnerPrestia

(57) ABSTRACT

A manufacturing method of a paper making part for a loudspeaker has freedom of adjusting a characteristic and a sound quality, and has a higher productivity. Accordingly, a fibrillating step of a paper making material is achieved by an explosive crushing step. Alternatively, the step is achieved by a mixing step of a paper making material and a liquid, a material micro-fabricating step of applying a pressure to a mixed solution obtained by the mixing step so as to pass through an orifice and thereafter run into a device wall, and a paper making step including the micro-fabricated material.

11 Claims, 7 Drawing Sheets

FOREIGN PATENT DOCUMENTS

| | | | |
|---|---|---|---|
| JP | 04-332300 | | 11/1992 |
| JP | 04-367198 | A | 12/1992 |
| JP | 05-211696 | | 8/1993 |
| JP | 06-062494 | | 3/1994 |
| JP | 06-311595 | | 11/1994 |
| JP | 06-311595 | A | 11/1994 |
| JP | 07-310296 | A | 11/1995 |
| JP | 09-084176 | | 3/1997 |
| JP | 10-013988 | | 1/1998 |
| JP | 11-075289 | | 3/1999 |
| JP | 11-323800 | | 11/1999 |
| JP | 2000-017592 | A | 1/2000 |
| JP | 2003-129392 | | 5/2003 |
| JP | 2003-129392 | A | 5/2003 |
| JP | 2003-230197 | | 8/2003 |
| JP | 2005-223807 | A | 8/2005 |

OTHER PUBLICATIONS

Japanese Office Action for Application No. 2006-091189, Feb. 8, 2011, Panasonic Corporation.

Chinese Office Action for Application No. 201000900647530, Oct. 13, 2010, Panasonic Corporation.

Japanese Search Report for Application No. PCT/JP2007/053352, May 15, 2007.

MANUFACTURING METHOD OF PAPER MAKING PART FOR LOUDSPEAKER, PAPER MAKING PART FOR LOUDSPEAKER, DIAPHRAGM FOR LOUDSPEAKER, SUB CONE FOR LOUDSPEAKER, DUST CAP FOR LOUDSPEAKER AND LOUDSPEAKER

This application is a divisional of U.S. patent application Ser. No. 11/813,555, filed on Jul. 9, 2007, which is a U.S. National Phase Application of PCT International Patent Application No. PCT/JP2007/053352 which is incorporated herein by reference.

TECHNICAL FIELD

The present invention relates to a manufacturing method of a paper making part for a loudspeaker used in various acoustic devices, a paper making part for a loudspeaker manufactured by this method, a diaphragm for a loudspeaker, a sub cone for a loudspeaker, a dust cap for a loudspeaker, and a loudspeaker using them.

BACKGROUND ART

With regard to an electronic device such as an acoustic device, an image device or the like in recent years, there has been intended exponentially an improvement of performance in comparison with a conventional one, on the basis of a noticeable progress of a digital technology.

On the basis of the improvement of performance of the electronic device, there has been strongly requested from a market an improvement of performance in a loudspeaker used in the electronic device.

In the loudspeaker in which the improvement of performance is strongly requested, it is essential to correspond to a high performance of a vibrating part centered on a diaphragm occupying a great weight for determining a sound quality in constituting parts of the loudspeaker.

As a part of a correspondence for making the vibrating part centered on the diaphragm high in the performance, there is attached a high value to a sound making and a characteristic making which satisfy user needs required per respective fields and respective intended uses.

A structure which can achieve the sound making and the characteristic making satisfying a user needs is a paper making part having an advantage which can fine adjust a characteristic and a sound quality as the loudspeaker, and a development of the paper making part has been developed.

A description will be given of a manufacturing method of the conventional paper making part for the loudspeaker with reference to FIG. 9 by exemplifying a diaphragm.

FIG. 9 is a process chart showing a manufacturing method of a conventional paper making diaphragm for the loudspeaker.

As shown in FIG. 9, a material of the paper making diaphragm for the loudspeaker is thrown in a beater containing a water, and is beaten finely in accordance with a beating step for some days.

Next, the beaten material is paper-made on a metal mold and a metal net arranged on the metal mold in accordance with a paper making step, whereby only a water content is discharged, and is formed in a shape serving as a paper making diaphragm for the loudspeaker in which the material is piled up.

Next, in accordance with a pressurizing step, the material of the piled-up paper making diaphragm for the loudspeaker is heated and pressurized, and the remaining water content is evaporated.

Next, in accordance with a working step (a drawing step), an outermost peripheral portion to be unnecessary and a center hole portion for inserting a voice coil thereto are drawn by the metal mold.

In accordance with the steps mentioned above, the conventional paper making diaphragm for the loudspeaker is finished.

In this case, the description is given above of the steps of the press diaphragm, however, there exists a manufacturing method for an oven diaphragm which is dried for one day or two days without pressing, that is, a so-called non-press diaphragm.

Further, the description is given above of the paper making diaphragm for the loudspeaker, however, a sub cone and a dust cap corresponding to the other paper making parts than the diaphragm are manufactured in accordance with a similar process.

In this case, as a prior art publication information, for example, there have been known a patent document 1 and a patent document 2.

In an acoustic business circle and an image business circle, there has been achieved a dramatic performance improvement on the basis of the significant development of the digital technology mentioned above. On the other hand, a tendency that a cost of a product becomes low is high, and in the loudspeaker used in the electronic device such as the acoustic device, the image device or the like, a market request for making the cost lower is significant.

In the conventional vibrating part for the loudspeaker which can satisfy the user needs, the paper making part formed by paper making the pulp material is a mainstream.

In the paper making part, since it is possible to vary a physical property value within a great range and in detail, the paper making part has an advantage that it is possible to fine adjust the characteristic as the loudspeaker and the sound quality, and has a problem that a lot of time is required for the beating step corresponding to a defect of the manufacturing method of the paper making part.

Patent Document 1: Unexamined Japanese Patent Publication No. 63-196790

Patent Document 2: Unexamined Japanese Patent Publication No. 2003-230197

DISCLOSURE OF THE INVENTION

The present invention solves the problem mentioned above, and provides a manufacturing method of a paper making part for a loudspeaker which can shorten a manufacturing time while constituting the paper making part.

In other words, the prevent invention provides a paper making part for a loudspeaker having a large freedom for adjusting a characteristic and a sound quality as the loudspeaker.

Accordingly, the present invention achieves a manufacturing method of a paper making part for a loudspeaker in accordance with a paper making molding by a fibrillating step of a material, and a paper making step of the fibrillated material.

In accordance with the manufacturing method, it is possible to prepare the material for making paper for a short time in the fibrillating step, and it is possible to provide the manufacturing method of the paper making part for the loudspeaker which can shorten a manufacturing time in spite of the paper making part.

Further, the present invention achieves a manufacturing method of a paper making part for a loudspeaker in accordance with a paper making molding, by a mixing step between a paper making material and a liquid, a material micro-fabricating step of applying a pressure to a mixed liquid obtained by the mixing step so as to pass through an orifice and thereafter run into a device wall, a paper making step of making paper including the micro-fabricated material obtained by the micro-fabricating step, and a shape working step of the paper making part obtained by the paper making step.

In accordance with the manufacturing method, it is possible to provide the manufacturing method of the paper making part for the loudspeaker which can prepare the material for making paper for a short time, and can shorten the manufacturing time in spite of the paper making part.

Accordingly, it is possible to provide the paper making part for the loudspeaker in which the freedom of adjusting the characteristic and the sound quality as the loudspeaker is great, at a high productivity, and it is possible to intend to make the cost of the loudspeaker low, whereby an industrial worth is very great.

DESCRIPTION OF REFERENCE NUMERALS

Figure 1:
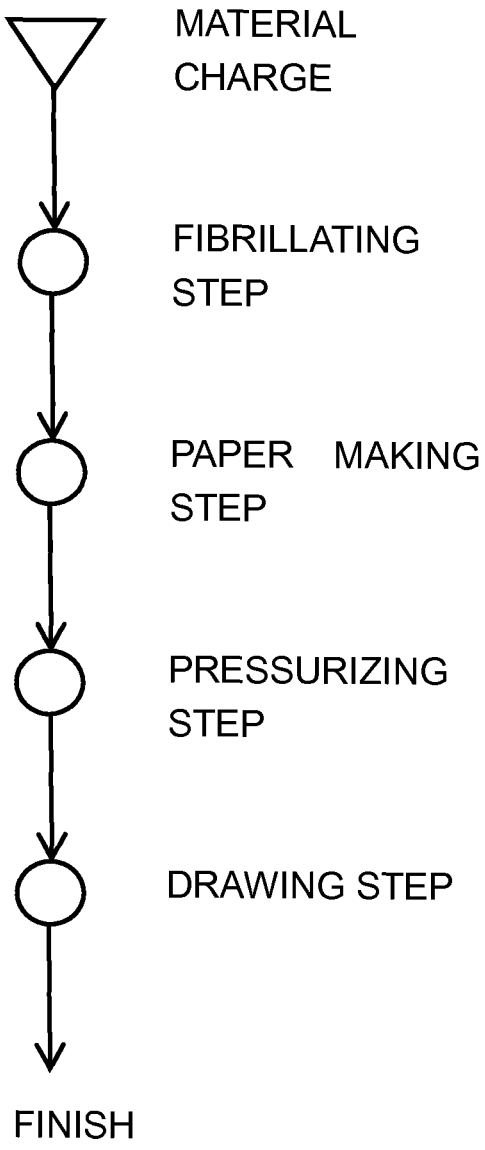
FIG. 1 is a process chart showing a manufacturing method of a paper making diaphragm for a loudspeaker in accordance with an embodiment 1 of the present invention.

21 magnet
22 upper plate
23 yoke
24 magnetic circuit
25 magnetic gap
26 frame
27 diaphragm for loudspeaker
28 voice coil
29 edge
30 sub cone for loudspeaker
31 dust cap for loudspeaker

PREFERRED EMBODIMENTS FOR CARRYING OUT OF THE INVENTION

A description will be given below of embodiments in accordance with the present invention with reference to the accompanying drawings.

Embodiment 1

FIG. 1 is a process chart showing a manufacturing method of a paper making diaphragm for a loudspeaker in accordance with an embodiment 1 of the present invention. In the embodiment 1, a description will be given by taking up the diaphragm for the loudspeaker as one example of the paper making part for the loudspeaker. In this case, the same matter is applied to the other paper making parts for the loudspeaker, for example, a sub cone for the loudspeaker, a dust cap for the loudspeaker, and the other paper making parts for the loudspeaker.

As shown in FIG. 1, a material of a paper making diaphragm for the loudspeaker is thrown in a container for fibrillating, and is finely fibrillated by a fibrillating step.

Next, the fibrillated material is paper made on a metal mold and a metal net arranged thereon so as to be discharged only a water content, and the material is piled up so as to be formed in a shape as the diaphragm for the loudspeaker.

Next, in accordance with a pressurizing step, the piled-up diaphragm material for the loudspeaker is heated and pressurized, and a remaining water content is evaporated.

Next, in accordance with a drawing step (a shape working step), an outermost peripheral portion to be unnecessary and a center hole portion for inserting a voice coil are drawn by a metal mold.

In accordance with the above, it is possible to finish the paper making diaphragm for the loudspeaker in accordance with the manufacturing method using the fibrillating step in accordance with the present invention.

In this case, the description is given above of the manufacturing method of the press molded diaphragm, however, it is possible to employ a manufacturing method of an oven diaphragm obtained by drying for one day to two days with doing away with the pressurizing step, that is, without press molding, in a state of setting the other steps than the pressurizing step the same, that is, a so-called non-press diaphragm.

The fibrillating step corresponding to the feature of the manufacturing method of the paper making diaphragm for the loudspeaker in accordance with the present invention is different from the conventional fibrillating step of finely beating the material by using a rotational equipment by a motor such as a beater, a refiner or a mixer and repeating the same motion for some days, corresponding to the conventional beating step.

The fibrillating step in accordance with the present invention includes, for example, an explosive crushing step.

The explosive crushing step throws the material of the paper making diaphragm for the loudspeaker for fibrillating in the container, closes the container, applies a pressure to an inner portion of the container, and applies a high pressure to the material.

Next, the increased pressure in the inner portion of the material is suddenly expanded by instantaneously opening the container to which the pressure is applied so as to set the container to a normal pressure state, whereby the material is finely fibrillated.

The explosive crushing may use a liquid as a medium, and in the case that the liquid employs a liquid having an alkalifying function, it is possible to simultaneously execute an alkali treating step.

Further, it is possible to more securely and efficiently fibrillate by setting the explosive crushing step to a steam cooking explosive crushing.

Further, it is possible to control a composition of a lignin, a hemicellulose and a cellulose in accordance with a steam cooling condition, and it is possible to achieve a manufacturing method of a paper making diaphragm having a higher precision.

As mentioned above, the fibrillating step is different from the conventional beating step, it is not necessary to make the material fine by repeating the same motion for some days, it is possible to instantaneously fibrillate on the basis of an increase and decrease of the pressure, and it is possible to widely shorten a producing time of the paper making diaphragm for the loudspeaker. Further, the fibrillating step mentioned above is particularly effective in manufacturing the paper making part for the loudspeaker using a material including a bamboo.

Accordingly, it is possible to establish the excellent manufacturing method of the paper making diaphragm for the loudspeaker which can shorten the manufacturing time in spite of the paper making diaphragm.

As mentioned above, it is possible to provide the paper making diaphragm for the loudspeaker in which the freedom of adjusting the characteristic and the sound quality for the loudspeaker is great, at a higher productivity, and it is possible to intend to make the cost of the loudspeaker lower.

Embodiment 2

Figure 2:
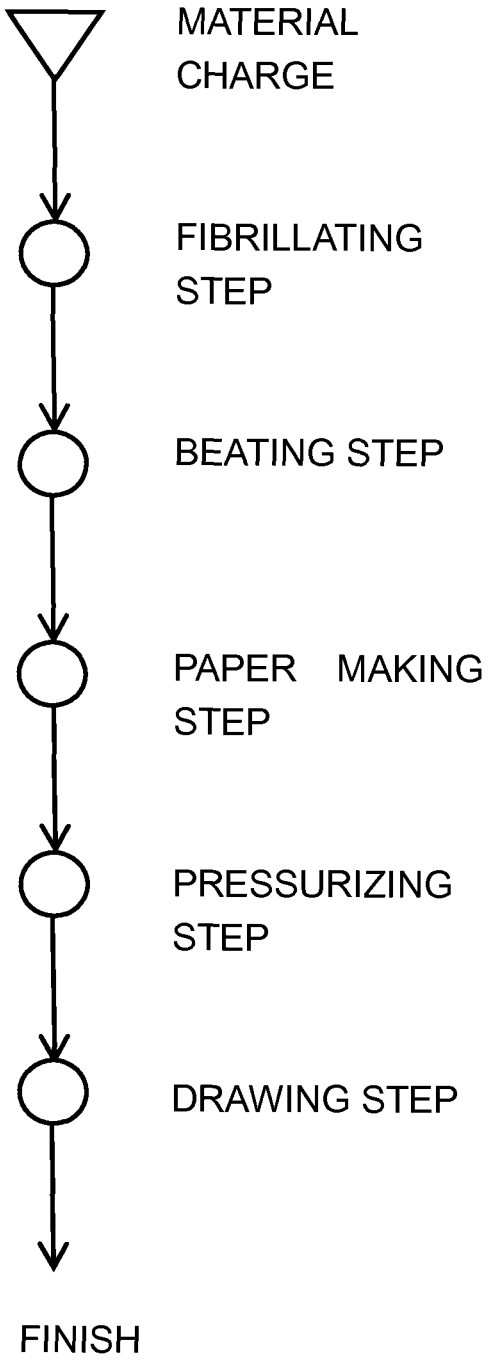
FIG. 2 is a process chart showing a manufacturing method of a paper making diaphragm for a loudspeaker in accordance with an embodiment 2 of the present invention.

FIG. 2 is a process chart showing a manufacturing method of a paper making diaphragm for a loudspeaker in accordance with an embodiment 2 of the present invention. In the embodiment 2, a description will be given by taking up the diaphragm for the loudspeaker as one example of the paper making part for the loudspeaker. In this case, the same matter is applied to the other paper making parts for the loudspeaker, for example, a sub cone for the loudspeaker, a dust cap for the loudspeaker, and the other paper making parts.

In FIG. 2, a description will be given of the same contents as those of the embodiment 1 while omitting the description thereof.

As shown in FIG. 2, a different point from the embodiment 1 exists in a point that a beating step is further provided between the fibrillating step and the paper making step.

The beating step is different from a series of beating steps from the material charge to the state capable of making paper which is required for some days as described in a conventional art, but corresponds to a beating step executed for fine adjusting the fibrillating degree, with respect to the material which is in the already fibrillated state. Accordingly, this beating step is finished for some minutes or some hours.

The fibrillated state of the material is uniformized or stabilized by setting the beating step, and it is possible to achieve the paper making having a high precision.

Further, the beating step may be provided with a micro fibrillating beating step. It is possible to further improve the fibrillating degree by further setting the micro fibrillating beating step, and it is possible to further improve an intertwining of the material fibers at a time of making paper. Accordingly, it is possible to obtain the excellent paper making diaphragm for the loudspeaker which has high rigidity and toughness.

In this case, the micro fibrillating means forming in a level not more than 200 ml in Canada standard beating degree. Further, in the micro fibrillating, it is preferable that an average fiber diameter is made smaller than 5μ, and L/D (average fiber length/average fiber diameter) is not less than 10. In other words, it is preferable that the average fiber length is made not less than 10 times of the average fiber diameter.

The beating step and the micro fibrillating beating step mentioned above correspond to a step of bearing by any one of a beater, a refiner and a mixer.

The micro fibrillating beating step is particularly effective in manufacturing the paper making part for the loudspeaker using the material including the bamboo.

As mentioned above, it is possible to inexpensively obtain the excellent paper making diaphragm for the loudspeaker which has a high precision and has high rigidity and toughness, by fine adjusting the fibrillating degree of the material fiber previously fibrillated in pieces by the fibrillating step, in accordance with the existing beating step by means of the beater, the refiner, the mixer or the like, or the micro fibrillating beating step.

Embodiment 3

In an embodiment 3, a description will be given of an example of a manufacturing method of a diaphragm for a loudspeaker with reference to FIG. 3, as the manufacturing method of the paper making part for the loudspeaker. In this case, the same matter is applied to the other paper making parts for the loudspeaker, for example, a sub cone for the loudspeaker, a dust cap for the loudspeaker, and the other paper making parts.

Figure 3:
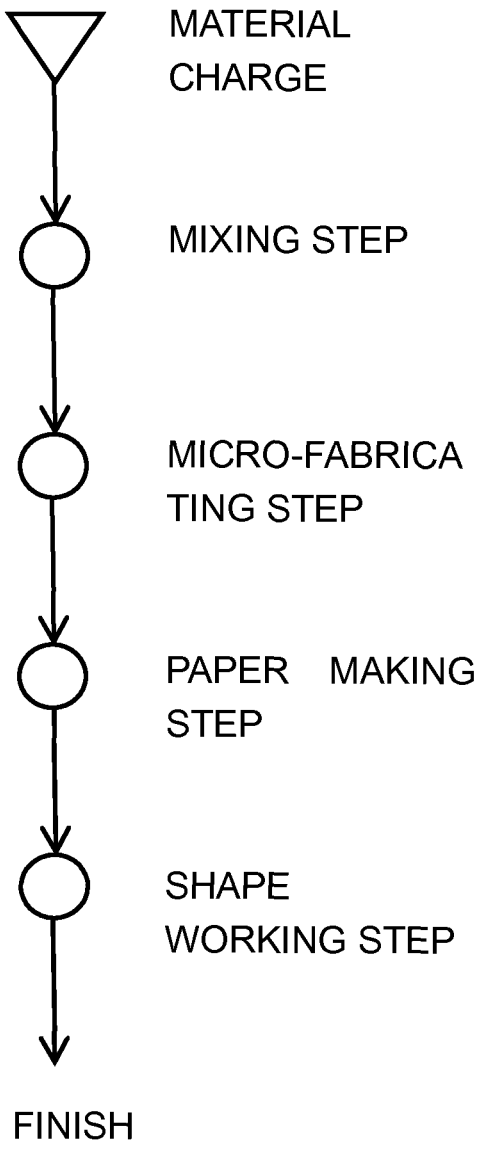
FIG. 3 is a process chart showing a manufacturing method of a paper making diaphragm for a loudspeaker in accordance with an embodiment 3 of the present invention.

FIG. 3 is a process chart showing a manufacturing method of a diaphragm for a loudspeaker in accordance with an embodiment 3 of the present invention.

As shown in FIG. 3, a material of the diaphragm for the loudspeaker is thrown, and the material and a liquid are mixed so as to obtain a mixed solution in accordance with a mixing step.

Next, in a micro-fabricating step, the mixed solution obtained by the mixing step is exposed to a pressure so as to be passed through a compact orifice and be thereafter run into the device wall at a high speed, and is decelerated thereafter, thereby applying a shear force and micro-fabricating the material. An apparatus suitable for this method is a pressure type homogenizer, and a combination of the fiber having a directionality such as the bamboo fiber and the pressure type homogenizer has an extremely great feathering promoting effect and is effective.

Next, in the paper making step, the micro-fabricated material is paper made on the metal mold and the metal net arranged thereon so as to be discharged only a water content, and the material is piled up so as to be formed in a shape as the diaphragm for the loudspeaker.

Further, in accordance with a pressurizing step (not shown), the piled-up diaphragm material for the loudspeaker is heated and pressurized, and a remaining water content is evaporated. In this case, the pressurizing step is not essential.

Next, in accordance with a shape working step, an outermost peripheral portion to be unnecessary and a center hole portion for inserting a voice coil thereto are drawn by the metal mold.

In accordance with the steps mentioned above, the paper making diaphragm for the loudspeaker is finished in accordance with the manufacturing method of the present embodiment 3.

In this case, the description is given above of the manufacturing step of the press diaphragm, however, it is possible to employ a manufacturing method of an oven diaphragm which does away with the pressurizing step, that is, which is dried for one day or two days without pressing, that is, a so-called non-press diaphragm, while being the same except the pressurizing step.

In this case, the micro-fabricating step of the material may be repeated at a plurality of times until a desired micro-fabricating is achieved without being limited to one time.

As mentioned above, it is possible to fine adjust the sound quality by obtaining the paper making diaphragm for the loudspeaker having the high precision, by repeating the micro-fabricating step of the material so as to achieve the desired micro-fabricating.

Further, in the micro-fabricating step, since it is possible to promote the micro-fabricating by making the pressure applied to the mixed solution not less than 10 MPa for passing through the compact orifice, it is possible to finish the micro-fabricating step for a short time.

Accordingly, since it is possible to carry out the micro-fabricating step mentioned above for a short time even if the micro-fabricating step is repeated, it is possible to achieve an improvement of a production efficiency.

Further, the water is generally used as the liquid mixed with the material, however, the liquid may be used by including an alcohol, or only the alcohol may be used.

It is possible to prevent the material from rotting by using the liquid including the alcohol as mentioned above, it is possible to shorten an evaporating time of the liquid such as the alcohol, the water content or the like including the alcohol or the like, on the basis of a good volatility, and it is possible to achieve an improvement of the production efficiency.

Further, it is possible to achieve a sound quality which is natural and bright and has a comfortable hearing while giving a feature of a natural product fiber a full play at a time of forming the paper making part for the loudspeaker starting from the diaphragm for the loudspeaker, by structuring the mixed solution in the mixing step mentioned above so as to include the natural product fiber having a concentration not less than 0.5 wt %. In this case, in the case that the concentration of the natural product fiber is less than 0.5 wt % in the mixed solution, the feature of the natural product fiber fails to be sufficiently achieved.

Further, in the same manner, it is possible to achieve a unique well-modulated sound quality having a high rigidity while giving a feature of a synthetic high polymer fiber a full play at a time of forming the paper making part for the loudspeaker starting from the diaphragm for the loudspeaker, by structuring the mixed solution so as to include the synthetic high polymer fiber having a concentration not less than 0.5 wt %. Further, it is also possible to reinforce various reliabilities as typified by a water resistance, a humidity resistance or the like. In this case, in the case that the concentration of the synthetic high polymer fiber is less than 0.5 wt %, the feature of the synthetic high polymer fiber fails to be sufficiently achieved.

As mentioned above, the micro-fabricating step corresponding to the feature of the manufacturing method in accordance with the present invention is different from the manufacturing method of beating the material into fine pieces by using the rotational equipment by the motor such as the beater, the refiner or the mixer and repeating the same motion for some days which corresponds to the conventional beating step.

It is possible to instantaneously micro-fabricate the paper making material in accordance with the micro-fabricating step, and it is possible to widely shorten the producing time of the paper making diaphragm for the loudspeaker. Further, the micro-fabricating step mentioned above is particularly effective in manufacturing the paper making part for the loudspeaker using the material including the bamboo.

Accordingly, it is possible to establish the excellent manufacturing method of the diaphragm for the loudspeaker which can shorten the manufacturing time in spite of the paper making diaphragm.

As mentioned above, the manufacturing method in accordance with the present invention can provide the paper making diaphragm for the loudspeaker having the greater freedom of adjusting the characteristic and the sound quality of the loudspeaker, at a higher productivity and can achieve a lower cost of the loudspeaker.

The description is given of the diaphragm for the loudspeaker, however, the paper making part for the loudspeaker includes the sub cone for the loudspeaker and the dust cap for the loudspeaker in addition to the diaphragm for the loudspeaker, it is possible to produce them in the same manufacturing method, and it is possible to achieve the same effect. Accordingly, a description will be omitted of the sub cone for the loudspeaker and the dust cap for the loudspeaker.

Embodiment 4

Figure 4:
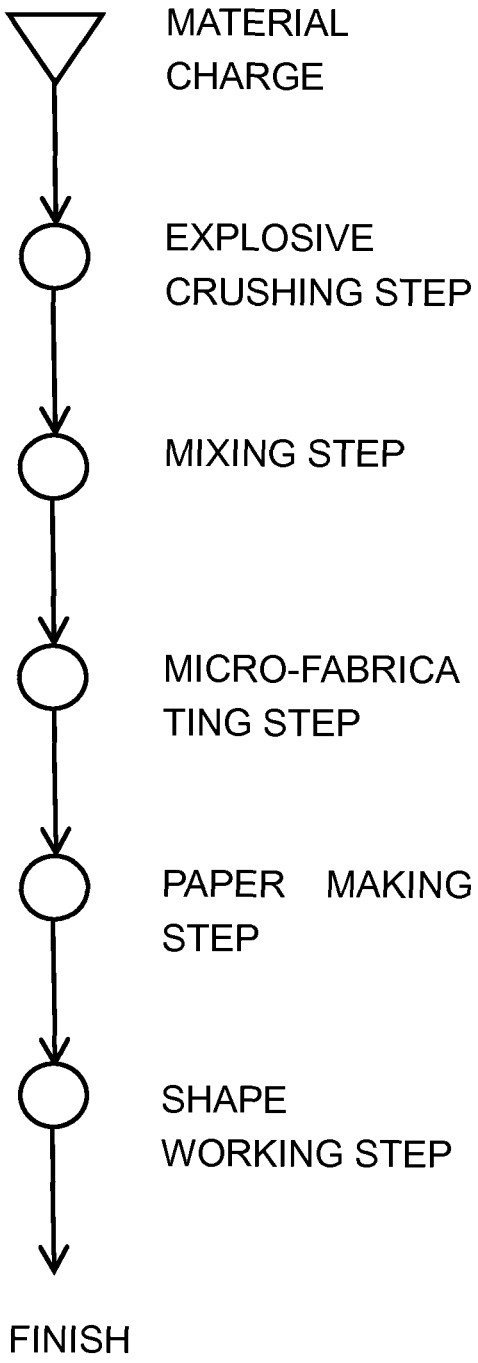
FIG. 4 is a process chart showing a manufacturing method of a paper making diaphragm for a loudspeaker in accordance with an embodiment 4 of the present invention.

FIG. 4 is a process chart showing a manufacturing method of a diaphragm for a loudspeaker in accordance with an embodiment 4 of the present invention.

A description will be given of FIG. 4 while omitting the description of the same contents as those of the embodiment 3.

As shown in FIG. 4, a different point from the embodiment 3 exists in an explosive crushing step provided before the mixing step.

The explosive crushing step is different from the series of beating steps from the material charge to the state capable of making paper which is required for some days as described in the conventional art, but corresponds to a step of instantaneously making the material fine on the basis of a pressure difference. In other words, it corresponds to the explosive crushing step described in the embodiment 1 in accordance with the present invention.

Further, it is possible to more securely and more efficiently make the material fine by setting the explosive crushing step to a steam cooking explosive crushing. Further, it is possible to control a composition of a lignin, a hemicellulose and a cellulose in accordance with a steam cooling condition, and it is possible to achieve a manufacturing method of a diaphragm for a loudspeaker having a higher precision.

It is particularly effective to add the explosive crushing step as mentioned above in the manufacturing of the paper making part for the loudspeaker using the material including the bamboo.

The explosive crushing step complexly generates the micro-fabrication of the fiber on the basis of the shear force caused by the collision and the micro-fabrication of the fiber on the basis of the pressure difference under a high pressure not less than 200 MPa, preferably not less than 300 MPa, and is effective. Further, a dramatic effect can be obtained by utilizing the bamboo fiber. It is estimated that the bamboo has a multiple-layered structure surface, and the fiber thereof is formed in a regular columnar shape, whereby the bamboo is very suitable in comparison with a timber fiber having an annual ring and formed as the fiber close to a flat plate shape.

The explosive crushing step can micro-fabricate instantaneously in comparison with the other steps, can maintain a higher productivity, and can further enlarge the freedom of adjusting the characteristic and the sound quality for the loudspeaker.

As mentioned above, it is possible to establish the manufacturing method of the diaphragm for the loudspeaker which can shorten the manufacturing time in spite of the paper making diaphragm, it is possible to provide the paper making diaphragm for the loudspeaker in which the freedom of adjusting the characteristic and the sound quality for the loudspeaker is very great at a further higher productivity, and it is possible to achieve a lower cost of the loudspeaker.

In this case, the embodiment 4 is also described about the diaphragm for the loudspeaker, however, the paper making part for the loudspeaker includes the sub cone for the loudspeaker and the dust cap for the loudspeaker in addition to the diaphragm for the loudspeaker, and can be produced in accordance with the same manufacturing method.

Embodiment 5

In an embodiment 5 in accordance with the present invention, a description will be given of a paper making part for a loudspeaker which is manufactured in accordance with the manufacturing methods of the paper making part for the loudspeaker described in the embodiments 1 to 4.

In this case, in the present embodiment 5, a description will be given of an example of the diaphragm for the loudspeaker as one embodiment of the paper making part for the loudspeaker.

Figure 5:
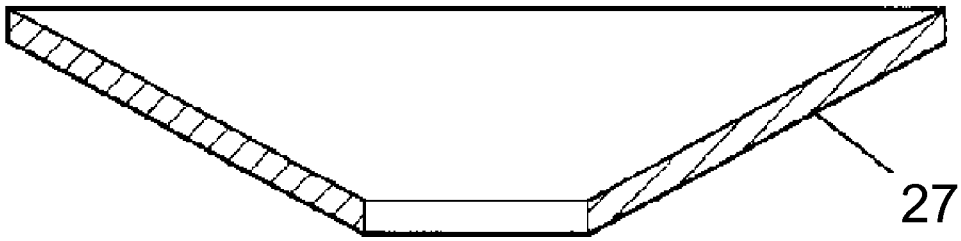
FIG. 5 is a view showing a center portion of a paper making diaphragm for a loudspeaker in accordance with an embodiment 5 of the present invention by a cross section.

FIG. 5 is a cross sectional view showing a center portion of the diaphragm for the loudspeaker in accordance with the embodiment 5 of the present invention.

Diaphragm 27 for the loudspeaker shown in FIG. 5 is constituted by the paper making diaphragm for the loudspeaker which is manufactured by the manufacturing method of the paper making part for the loudspeaker in accordance with any one of the embodiment 1 to the embodiment 4. Diaphragm 27 for the loudspeaker is manufactured by the manufacturing method of the paper making part for the loudspeaker including the explosive crushing step corresponding to the fibrillating step, as described in the embodiment 1 or the embodiment 2. Alternatively, it is manufactured by the manufacturing method of the paper making part for the loudspeaker including the beating step or the micro-fibrillating beating step between the fibrillating step and the paper making step.

Alternatively, diaphragm 27 for the loudspeaker is achieved by the mixing step between the paper making material and the liquid, the material micro-fabricating step of applying the pressure to the mixed solution obtained in the mixing step so as to pass through the orifice and thereafter run into the device wall, the paper making step of paper making while including the micro-fabricated material obtained by the micro-fabricating step, and the shape working step of the paper making part obtained by the paper making step.

Accordingly, since it is possible to shorten the manufacturing time in spite of the paper making diaphragm, it is possible to provide the diaphragm at a higher productivity as well as it is possible to enlarge the freedom of adjusting the characteristic and the sound quality for the loudspeaker, and it is possible to achieve the lower cost of the diaphragm for the loudspeaker.

In this case, in the diaphragm for the loudspeaker, it is possible to achieve the diaphragm for the loudspeaker having the high rigidity and toughness in which an intertwining of the fiber is strengthened while giving the feature of the micro-fabricated material full play, by structuring so as to include 3 to 20 wt % of the micro-fabricated material mentioned above, and it is possible to achieve an elongation of a high pass threshold frequency and an improvement of a reliability. In this case, in the case that the content of the micro-fabricated material fiber is less than 3 wt %, the effect can not be sufficiently achieved, and if the content gets over 20 wt %, the cost becomes higher in comparison with an appearance of the effect.

Further, it is possible to achieve the diaphragm having further higher rigidity and toughness by using the bamboo fiber as the micro-fabricated material, it is possible to achieve the elongation of the high pass threshold frequency and the improvement of the reliability, and it is possible to achieve a diaphragm which is easy on the global environment by using the bamboo which more quickly grows in comparison with a coniferous tree.

Figure 6:
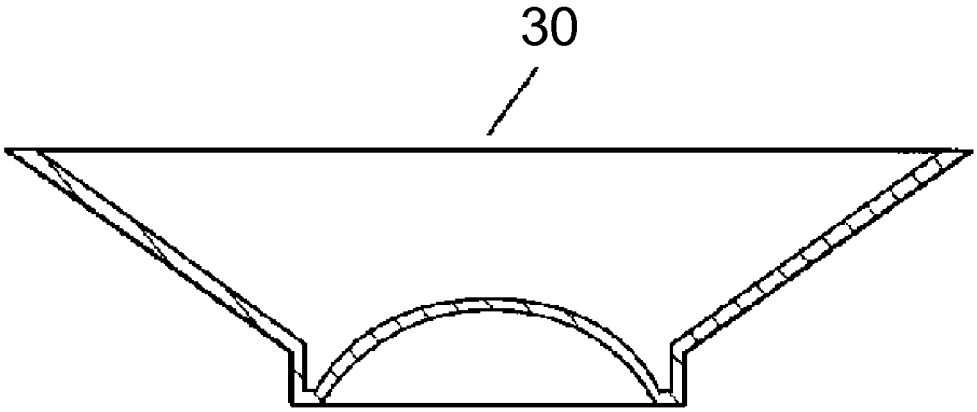
FIG. 6 is a view showing a center portion of a sub cone for the loudspeaker manufactured by the manufacturing methods described in the embodiments 1 to 4 by a cross section.
Figure 7:
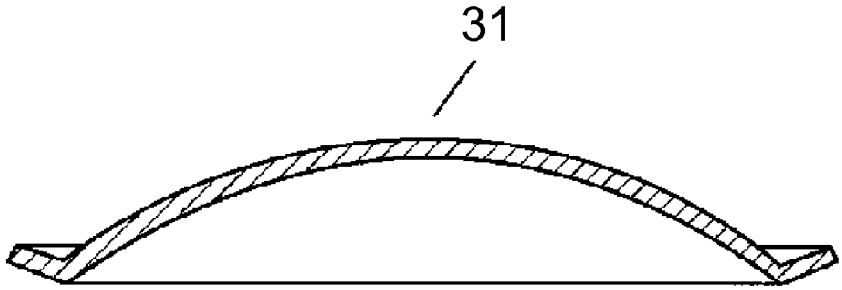
FIG. 7 is a view showing a center portion of a dust cap for the loudspeaker manufactured by the manufacturing methods described in the embodiments 1 to 4 by a cross section.

The description is given above of diaphragm 27 for the loudspeaker in the paper making parts for the loudspeaker, however, the embodiments 1 to 4 in accordance with the present invention can be applied to sub cone 30 for the loudspeaker shown in FIG. 6 and dust cap 31 for the loudspeaker shown in FIG. 7 which are manufactured in accordance with the manufacturing method of the paper making part for the loudspeaker described in the embodiments 1 to 4 of the present invention, and it is possible to achieve the same effects as the effects mentioned above.

Embodiment 6

Figure 8:
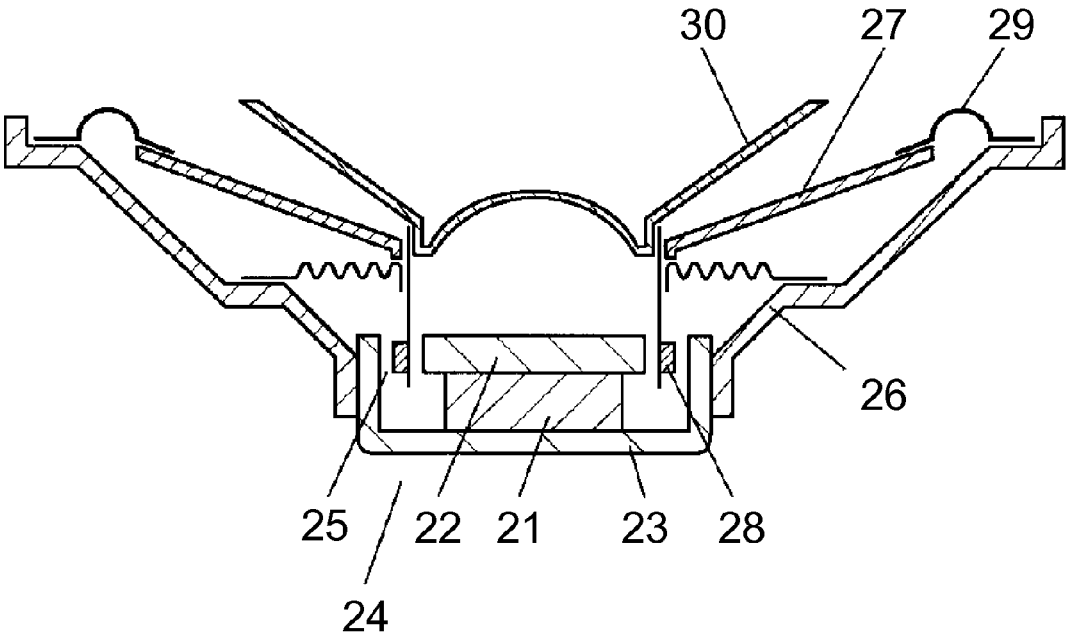
FIG. 8 is a cross sectional view of a center portion of a loudspeaker in accordance with an embodiment 6 of the present invention.
Figure 9:
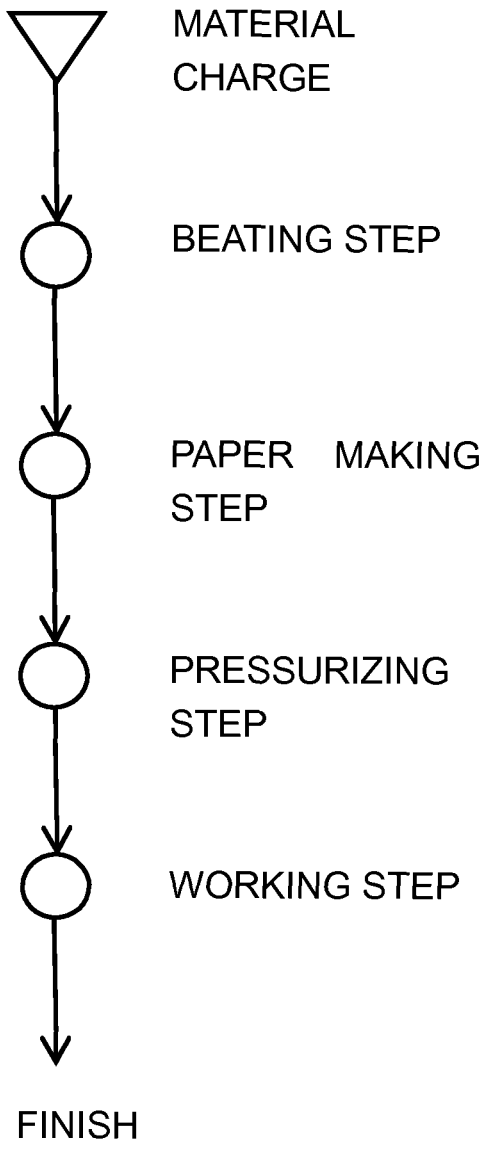
FIG. 9 is a process chart showing a manufacturing method of a conventional paper making diaphragm for a loudspeaker.

FIG. 8 shows a cross sectional view of a center portion of a loudspeaker in accordance with an embodiment 6 of the present invention.

As shown in FIG. 8, magnetic circuit 24 of an inner magnetic wall is structured by sandwiching magnetized magnet 21 by upper plate 22 and yoke 23.

Frame 26 is coupled to yoke 23 of magnetic circuit 24. An outer periphery of diaphragm 27 for the loudspeaker described in the embodiment 5 of the present invention is adhered to a peripheral edge portion of plate 26 via edge 29. Further, one end of voice coil 28 is coupled to a center portion of diaphragm 27 for the loudspeaker, and an opposite one end is coupled to magnetic gap 25 of magnetic circuit 24 so as to be fitted thereto, whereby the loudspeaker is structured.

Further, sub cone 30 for the loudspeaker described in the embodiment 5 in accordance with the present invention is coupled to a front surface of the center portion of diaphragm 27 for the loudspeaker. In this case, in place of sub cone 30 for the loudspeaker, it is possible to employ a dust cap for the loudspeaker described in the embodiment 5 of the present invention, (which is not illustrated in FIG. 8, but corresponds to dust cap 31 for the loudspeaker shown in FIG. 7). Alternatively, the loudspeaker may be structured such as to include both of the sub cone for the loudspeaker described in the embodiment 5 of the present invention, and the dust cap for the loudspeaker described in the embodiment 5 of the present invention in the same manner. Alternatively, the loudspeaker may be structured such as not to include both of the sub cone for the loudspeaker and the dust cap for the loudspeaker described in the embodiment 5 of the present invention, but to include the diaphragm for the loudspeaker described in the embodiment 5 of the present invention.

The description is given of the loudspeaker having inner magnet type magnetic circuit 24, however, the structure is not limited to this, but the present invention can be applied to a loudspeaker having an outer magnet type magnetic circuit.

Further, the present invention can be applied to a compact loudspeaker in which diaphragm 27 and edge 29 are integrated.

In accordance with this structure, it is possible to inexpensively achieve the excellent loudspeaker which uses the paper making diaphragm for the loudspeaker, has the good sound quality and can adjust the characteristic and the tone quality at a high precision.

Further, as the other effect, the rigidity and the toughness of the diaphragm for the loudspeaker, the sub cone and the dust cap are improved, and it is possible to obtain the loudspeaker which is excellent in terms of a quality and a reliability.

Accordingly, it is possible to improve various reliabilities as typified by the high input resistance of the loudspeaker, and the humidity resistance reliability which is important to the loudspeaker for the motor vehicle, and it is possible to inexpensively provide the loudspeaker which is excellent in the performance and in terms of the quality and the reliability.

INDUSTRIAL APPLICABILITY

The manufacturing method of the paper making part for the loudspeaker in accordance with the present invention can achieve both the higher productivity and the lower cost for shortening the manufacturing time, and can be effectively applied as the manufacturing method of the paper making part for the loudspeaker.

The invention claimed is:

1. A manufacturing method of a paper making part for a loudspeaker in accordance with a paper making molding comprising:

a mixing step of mixing a paper making material and a liquid;

a micro-fabricating step of the paper making material of applying a pressure to a mixed solution obtained by the mixing step so as to pass through an orifice and thereafter run into a device wall;

a paper making step of paper making while including the micro-fabricated material obtained by the micro-fabricating step; and a forming work step of the paper making part obtained by the paper making step;

wherein an explosive crushing step is further provided before the mixing step.

2. The manufacturing method of the paper making part for the loudspeaker according to claim 1, wherein the micro-fabricating step is repeated at a plurality of times.

3. The manufacturing method of the paper making part for the loudspeaker according to claim 1, wherein the pressure is set to be not less than 10 MPa.

4. The manufacturing method of the paper making part for the loudspeaker according to claim 1, wherein an alcohol is included in the liquid.

5. The manufacturing method of the paper making part for the loudspeaker according to claim 1, wherein the explosive crushing step is executed by a steam cooking explosive crushing.

6. The manufacturing method of the paper making part for the loudspeaker according to claim 1, wherein the mixed solution includes a natural fiber having a concentration not less than 0.5 wt %.

7. The manufacturing method of the paper making part for the loudspeaker according to claim 1, wherein the mixed solution includes a synthetic high polymer fiber having a concentration not less than 0.5 wt %.

8. The manufacturing method of the paper making part for the loudspeaker according to claim 1, wherein an average fiber diameter of the desired micro-fabricating is made smaller than 5μ.

9. The manufacturing method of the paper making part for the loudspeaker according to claim 1, wherein the micro-fabricating is in a level not more than 200 ml in Canada standard beating degree.

10. A paper making part for a loudspeaker manufactured by a manufacturing method comprising:

a mixing step of mixing a paper making material and a liquid;

a micro-fabricating step of the paper making material of applying a pressure to a mixed solution obtained by the mixing step so as to pass through an orifice and thereafter run into a device wall;

a paper making step of paper making while including the micro-fabricated material obtained by the micro-fabricating step; and a forming work step of the paper making part obtained by the paper making step;

wherein the micro-fabricating material is included at 3 to 20 wt % with respect to the paper making part.

11. The paper making part for the loudspeaker according to claim 1, wherein the micro-fabricating material includes a bamboo fiber.

* * * * *